US006216610B1

(12) United States Patent
Brunnmair et al.

(10) Patent No.: US 6,216,610 B1
(45) Date of Patent: Apr. 17, 2001

(54) PROCESS AND DEVICE FOR INCINERATION OF PARTICULATE SOLIDS

(75) Inventors: Erwin Brunnmair; Gerhard Moosmann, both of Graz (AT)

(73) Assignee: Andritz-Patentverwaltungs-Gesellschaft m.b.H., Graz (AU)

( * ) Notice: Subject to any disclaimer, the term of this patent is extended or adjusted under 35 U.S.C. 154(b) by 0 days.

(21) Appl. No.: 09/283,584

(22) Filed: Apr. 1, 1999

(30) Foreign Application Priority Data

Apr. 17, 1998 (AT) ..... 647/98

(51) Int. Cl.[7] ..... F23B 1/12; F23G 7/06; F23G 5/12

(52) U.S. Cl. ..... 110/213; 110/295; 110/296; 110/251; 110/208; 110/210; 110/211; 110/212

(58) Field of Search ..... 110/295, 296, 110/243, 264, 251, 208, 210, 211, 212, 213, 214, 261, 262, 265, 345; 432/138, 146, 149, 175

(56) References Cited

U.S. PATENT DOCUMENTS

| | | | | |
|---|---|---|---|---|
| 548,254 | * | 10/1895 | Horsfall | 110/251 |
| 1,952,227 | * | 3/1934 | Adams | 110/251 |
| 2,121,661 | * | 6/1938 | Hartley et al. | 110/12 |
| 3,577,940 | | 5/1971 | Hasselbring | 110/8 |
| 4,246,853 | * | 1/1981 | Mehta | 110/347 |
| 4,391,208 | * | 7/1983 | Lewis | 110/346 |
| 4,398,477 | | 8/1983 | Iwasaki | 110/346 |
| 4,408,548 | * | 10/1983 | Schmalfeld | 110/347 |
| 4,508,039 | * | 4/1985 | Neguchi et al. | 110/258 |
| 4,512,267 | * | 4/1985 | Cegielski, Jr. et al. | 110/347 |
| 4,672,900 | * | 6/1987 | Santalla et al. | 110/264 |
| 4,850,288 | * | 7/1989 | Hoffert et al. | 110/214 |
| 5,024,170 | * | 6/1991 | Santanam et al. | 110/264 |
| 5,050,512 | * | 9/1991 | Tratz et al. | 110/346 |
| 5,123,361 | * | 6/1992 | Nieh et al. | 110/264 |
| 5,245,936 | * | 9/1993 | Nakata | 110/251 |
| 5,429,060 | * | 7/1995 | Tokuda et al. | 110/263 |

FOREIGN PATENT DOCUMENTS

| | | |
|---|---|---|
| 9012249 | 10/1990 | (WO) . |
| 9214969 | 9/1992 | (WO) . |

* cited by examiner

*Primary Examiner*—Denise L. Ferensic
*Assistant Examiner*—K. B. Rinehart
(74) *Attorney, Agent, or Firm*—Roylance, Abrams, Berdo & Goodman, L.L.P.

(57) ABSTRACT

A process for the incineration of particulate solids, especially biological waste matter with low caloric value, feeds the solids into a combustion chamber of a furnace together with a sub-stoichiometric amount of fresh air to control the rate of combustion and to inhibit the formation of sintered ash. The furnace for implementing the process can be a cyclone furnace having a primary combustion chamber with a first feed inlet for the solids and air and a second air inlet positioned between the first inlet and an exhaust gas outlet. A supply tube extends through the exhaust gas outlet of the primary combustion chamber to supply a source of fresh air at ambient temperature to maintain the primary combustion chamber at a desired temperature. The fresh air maintains the furnace temperature at least at about 850° C. and generally at about 850° C. to less than about 1100° C. A source of fresh air at ambient temperature can also be directed into the primary combustion chamber through an annular air passage surrounding the exhaust gas outlet of the primary combustion chamber. The less than stoichiometric amount of air and the secondary air maintains the furnace at a sufficiently lower temperature to inhibit sintering of the solids.

21 Claims, 6 Drawing Sheets

PROCESS AND DEVICE FOR INCINERATION OF PARTICULATE SOLIDS

FIELD OF THE INVENTION

The present invention relates to a process and apparatus for the incineration of particulate solids and particularly, biological waste materials with low caloric values. The invention is further directed to a process and apparatus for incinerating previously dried solid particulates, such as municipal sludge, with reduced formation of sintered ash.

BACKGROUND OF THE INVENTION

Various processes and devices have been developed for incinerating solid particulate materials for various purposes. In particular, municipal waste and sewer sludge generally must be incinerated before disposal in a landfill. The environmental regulations in many countries limit the amount of organic material which can be present in the sludge prior to disposal. Accordingly, various efforts have been proposed to incinerate municipal waste material and sewer sludge to comply with the regulations.

One example of a known process for incinerating waste materials is disclosed in WO 92/14969. This publication discloses a process for feeding finely ground, previously dried sludge into a brick lined combustion chamber, together with a supply of primary combustion air. The furnace is a cyclone combustion chamber having a lower section where the incineration of the solid material takes place. A predetermined amount of moist air with a reduced oxygen content is fed into the combustion chamber to inhibit the sintering of the ash. The ash discharge area of the combustion chamber is cooled using the moist air. The amount of air needed as the primary combustion air and the secondary source of moist air is typically preset for a specific furnace size. The heat output of the furnace is regulated by adjusting the amount of the solid material being incinerated in relation to the fixed amount of the primary combustion air. This device has several disadvantages and is not completely efficient in incinerating solid materials. For example, the process disclosed in this publication is generally difficult to regulate and the output of the incinerated material can be adjusted over a very small operating range. Furthermore, fluctuations in the level of solid material being incinerated and the caloric value of the solid material produces inconsistent results in the incineration of the solid material.

Accordingly, there is a continuing need in the industry for improved processes and apparatus for incinerating solid materials.

SUMMARY OF THE INVENTION

The present invention is directed to a process and apparatus for the incineration of particulate solid materials. More particularly, the invention is directed to a process and apparatus for incinerating biological waste materials with low caloric value with a reduced output of sintered ash.

Accordingly, a primary object of the invention is to provide a process and apparatus for incinerating solid materials containing organic matter, such as sewage sludge, in a rapid and efficient manner.

Another object of the invention is to provide a process and apparatus for incinerating organic materials at low temperatures and to incinerate the materials having a lower ash fusion point without ash sintering.

A further object of the invention is to provide a process and apparatus for incinerating organic materials in a furnace and to remove the ash more effectively from the exhaust gas stream.

A still further object of the invention is to provide a process and apparatus for incinerating organic materials in a furnace and for maintaining a temperature of about 1100° C. or less, and preferably about 850° C.

Another object of the invention is to provide a process and apparatus for incinerating solid particulate materials by blowing a mixture of the solid materials and a sub-stoichiometric proportion of fresh air into a combustion chamber of a furnace.

Another object of the invention is to provide a process and apparatus for incinerating solid particulate materials where the solid material is incinerated in a first combustion zone containing a deficiency of oxygen followed by feeding additional air to a second combustion zone to provide an excess of oxygen and to further incinerate the solid particulate materials.

A further object of the invention is to provide a process and apparatus for incinerating solid materials containing organic matter with reduced formation of carbon monoxide.

Another object of the invention is to provide a process and apparatus for incinerating solid particulate materials containing organic matter where a second source of moist air with a reduced oxygen content compared to the primary combustion air is fed into the furnace to maintain the operating temperature of the furnace at about 850° C.

Another object of the invention is to provide a process and apparatus for feeding recycled moist air from a drying plant, and feeding the moist air into the furnace for incinerating solid particulate materials.

Another object of the invention is to provide a cyclone furnace having an annular shaped inlet tube for feeding secondary air into the combustion zone of the furnace in an axial direction.

A further object of the invention is to provide an apparatus for incinerating solid materials where the furnace includes a centrally located feed tube extending axially through the furnace and the feed tube having a plurality of openings therein for supplying a secondary air source to the combustion zone.

The objects and advantages of the invention are basically attained by providing a process for incinerating solid particulate materials comprising the steps of: introducing a feed mixture into a first combustion zone of a furnace, the furnace having a lower end and an upper end defining a primary combustion chamber, the feed comprising the solid particulate material and a first source of combustion air in an amount less than a stoichiometric amount needed to completely incinerate the particulate material; and incinerating the solid particulate material in a first incinerating stage in the primary combustion zone in an atmosphere containing less than a stoichiometric amount of air to inhibit the formation of sintered ash.

The objects and advantages of the invention are further attained by providing an apparatus for incinerating solid particulate materials comprising a furnace wall defining a primary combustion chamber and having a lower end and an upper end; a burner coupled to the furnace wall for introducing hot combustion gases into the primary combustion chamber; a first feed inlet for feeding a feed mixture into a first combustion zone in the primary combustion chamber, the feed mixture including a solid particulate material and a first source of combustion air in less than a stoichiometric amount needed for complete combustion of the solid particulate material; and a second feed inlet for feeding a second source of air into the primary combustion chamber.

The objects and advantages are also attained by providing a furnace for incinerating a solid particulate material comprising: at least one side wall, a bottom wall, a top wall, and an intermediate wall extending substantially perpendicular to the side wall in an inward direction toward an axial center of the furnace, the intermediate wall having a throat opening concentric with a center axis of the furnace and defining a primary combustion chamber in a lower portion of the furnace and a secondary combustion chamber in an upper portion of the furnace; a feed inlet device in the side wall for feeding a feed mixture tangentially into the primary combustion chamber, the feed mixture including a solid particulate material and combustion air in less than a stoichiometric amount needed for complete combustion of the particulate material; and at least one feed pipe for feeding a supply of fresh air into the center of the primary combustion chamber in an amount to cool the primary combustion chamber at a temperature of about 850° C.

Other objects, advantages and salient features of the present invention will become apparent from the following detailed description which, taken in conjunction with the annexed drawings, discloses preferred embodiments of the present invention.

BRIEF DESCRIPTION OF THE DRAWINGS

Referring to the drawings which form a part of this original disclosure.

DETAILED DESCRIPTION OF THE INVENTION

The present invention is directed to a process and apparatus for incinerating solid particulate materials. In particular, the invention is directed to a process and apparatus for incinerating solid materials having an organic component which can be incinerated to remove the organic component from the solid particles. The process and apparatus are particularly suitable for incinerating municipal waste sludges, and particularly sewer sludge, although other solid materials can be incinerated efficiently. In embodiments of the invention, the solid material is previously dried sewage sludge having a moisture content of about 2–10% by weight, corresponding to a dry content of about 90–98% by weight. The solid materials being incinerated generally contain a number of different compounds and components such that the solid particles have a relatively low caloric value.

Figure 1:
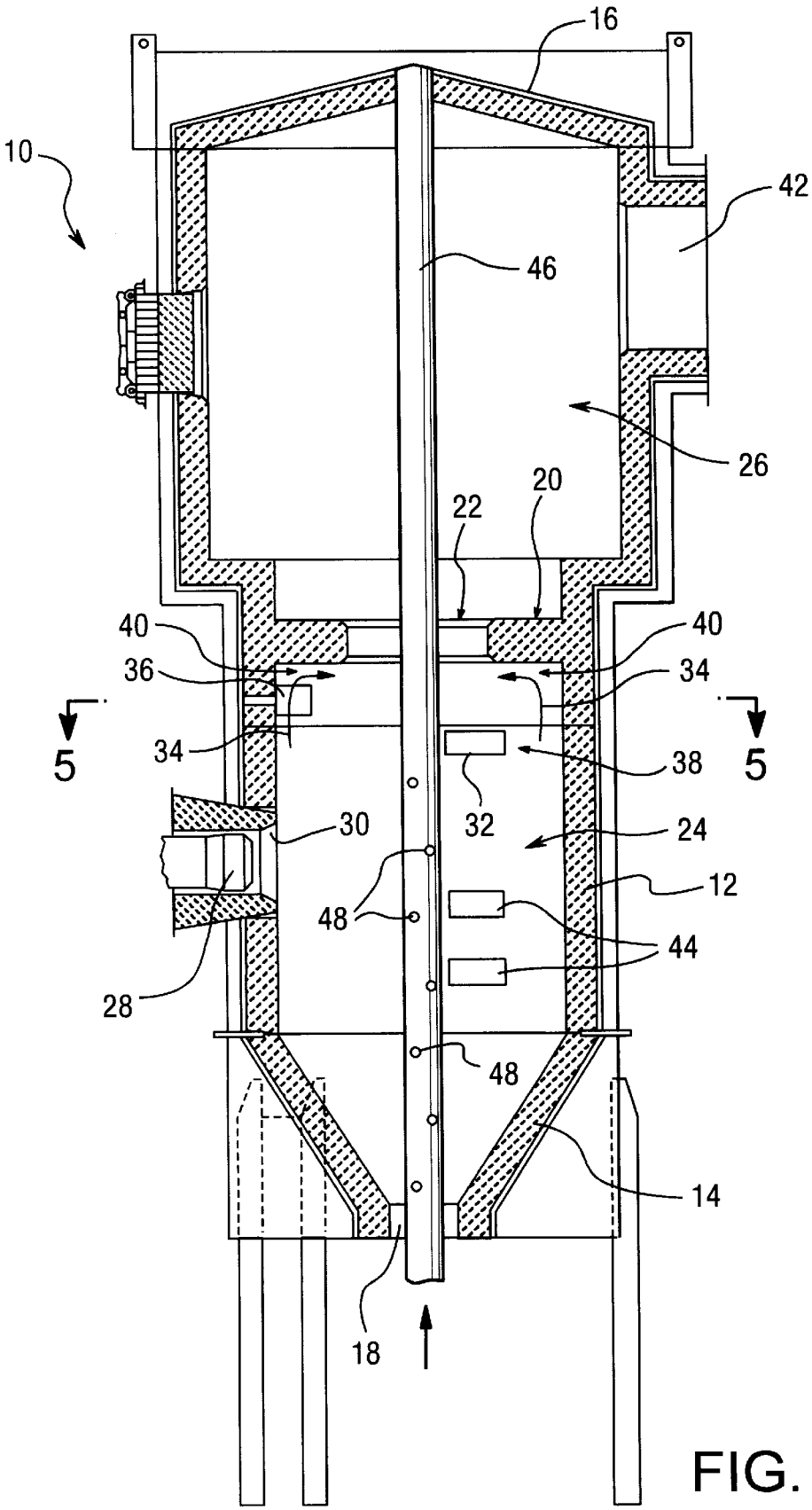
FIG. 1 is a cross-sectional side view of a cyclone furnace in a first embodiment of the invention.

In a first embodiment of the invention shown in FIG. 1, the apparatus is in the form of a cyclone furnace 10 having a side wall 12, a bottom wall 14 and a top wall 16. In the embodiment illustrated, the bottom wall 14 has a substantially frustoconical shape converging toward a central discharge opening 18 in the bottom portion of the furnace 10.

The furnace 10 includes an intermediate wall 20 extending substantially perpendicular to the side wall 12 and having a central opening forming a throat 22. The throat 22 in the intermediate wall 20 is positioned in the center of the furnace 10 such that the center axis of the furnace extends through the center of the throat 22. As shown in FIG. 1, the center opening of the throat 22 in the intermediate wall is aligned with the discharge opening 18 in the bottom wall 14.

The intermediate wall 20 divides the furnace 10 into a primary combustion chamber 24 located in the lower portion of the furnace and a secondary combustion chamber 26 located in the upper portion of the furnace 10. A burner 28 is positioned in an opening 30 in the side wall 12 in the primary combustion chamber 24 which feeds a fuel and air mixture and hot combustion gases into the furnace to ignite the fuel material being incinerated and assist in the combustion of material being fed into the furnace. In the embodiment illustrated, the burner 28 is positioned to direct the hot combustion gases radially into the primary combustion chamber 24 toward the axial center and is positioned at approximately the midpoint between the intermediate wall 20 and the discharge opening 18.

An injection nozzle 32 is mounted tangentially in the side wall 12 in the primary combustion chamber 24. The nozzle 32 is provided to supply a feed mixture of the solid particulate material and primary combustion air. The solid material is generally a biological waste material which functions as a fuel for feeding into the primary combustion chamber 24 for incineration. In preferred embodiments of the invention, the feed mixture supplied through nozzle 32 contains fresh air in an amount less than a stoichiometric amount needed to support complete combustion of the solid material. Generally, the amount of the primary combustion air supplied with the solid material is in an amount to transport the solid particles through the feed nozzle 32 and into the furnace. The nozzle 32 is adjustable to control the feed rate of the feed mixture and to direct the feed mixture in a circular fashion around the side wall 12 of the furnace 10.

The solid particulate material of the feed mixture is incinerated in the primary combustion chamber 24 with the assistance of the burner 28. The feed mixture follows a spiral path in a generally downward direction and then flows upwardly in a generally axial direction toward the throat 22. Ash is formed in the primary combustion chamber and removed from the cyclone furnace through the discharge opening 18. The amount of the fresh air stream fed through the nozzle 32 can be selected to provide the desired extent of combustion and can be adjusted according to the combustion capacity of the furnace and the amount of the solid material in the feed mixture as well as the caloric value of the solid material in the feed mixture.

The larger incinerated particles fall downwardly through the primary combustion chamber 26 and are discharged through the outlet 18. The fine particles are generally carried upwardly along the side wall 12 in a secondary stream indicated by arrows 34. As shown in FIG. 1, the nozzle 32 for supplying the feed mixture is spaced axially from the throat opening 22 in the intermediate wall 20. The nozzle 32 is positioned at the upper end of the primary combustion chamber 26 and above the burner 28.

A nozzle 36 is provided in the side wall 12 in the primary combustion chamber 24 and is positioned between the throat opening 22 in the intermediate wall 20 and the injection nozzle 32. The nozzle 36 feeds a source of secondary air tangentially into the primary combustion chamber 24 to direct a secondary air stream 34 in a circular fashion around the interior of the side wall 12. Preferably, the nozzle 36 supplies a secondary source of air to provide an excess amount of oxygen for supporting substantially complete combustion of the solid material in the feed mixture. The secondary air is fed at a temperature less than the internal temperature of the furnace to provide a cooling effect and prevent overheating of the furnace and the solid material being incinerated. The secondary air supplied through the nozzle 36 reduces the amount of the fine particle size solid material from being discharged through the opening 22 and being carried to the secondary combustion chamber 26. The secondary air preferably has an oxygen content less than the normal oxygen content of atmospheric air. Typically, the secondary air has an oxygen content of about 8.0–10.0% compared to about 21% of air. In embodiments, the secondary air is recycled drying air from a drying plant containing moisture and exhaust gases and has an oxygen content of about 8.0 to 10% and a temperature of about 45° C. to about 60° C.

In the embodiment illustrated in FIG. 1, the feed mixture of solid material and primary combustion air are fed into the primary combustion chamber 24 through the nozzle 32 such that the solid material is at least partially incinerated in a first combustion zone 38 in the vicinity of the nozzle 32. The feed mixture contains less than a stoichiometric amount of oxygen for the solid particulate fuel material such that the solid material is only partially incinerated in the first combustion zone 38. By feeding less than a stoichiometric amount of oxygen with the solid material, the temperature in the first combustion zone can be maintained at a temperature of about 850° C. and prevents or inhibits the formation of sintered ash.

The supply of secondary air through the nozzle 36 which is positioned above the nozzle 32 forms a second combustion zone 40 in the upper portion of the primary combustion chamber 24. The secondary air is supplied in an amount to effect complete combustion and incineration of the solid material. This provides a two stage combustion process which prevents overheating of the solid material and prevents sintering of the ash. The secondary air typically has a reduced oxygen content which reduces the rate of combustion to maintain the temperature in the first and second combustion zones below the sintering temperature of the ash. The incinerated particles fall downwardly through the furnace and are discharged through the opening 18 and the exhaust gases are discharged through the opening 22 where they are conveyed through the secondary combustion chamber 26 for complete combustion of fuel and unburned materials.

The exhaust gases in the secondary combustion chamber 26 are discharged through an outlet opening 42 in the side wall of the secondary combustion chamber 26. The exhaust gases are then fed through a heat exchanger for recovering the heat for various process steps, such as the drying of sewer sludge in a drying plant. Alternatively, the exhaust gases can be recycled to a preceding drier loop or treated appropriately for discharging to the atmosphere.

As shown in FIG. 1, a plurality of nozzles 44 are provided in the lower section of the primary combustion chamber 24 to feed a source of air tangentially into the bottom portion of the furnace. Preferably, the air fed through the nozzles 44 is moist air with a reduced oxygen content fed from a drier loop in a drying plant. The amount of moist air fed through the nozzles 44 can be adjusted to maintain the temperature in the primary combustion chamber 24 sufficiently low to prevent the sintering of ash in the combustion chamber as it falls downwardly toward the discharge opening 18. In this manner, the temperature in the lower portion of the primary combustion chamber can be controlled to prevent overheating of the incinerated particles. The moist air typically has an oxygen content of about 8.0% to 10% which is lower than the oxygen content of the feed mixture supplied through nozzle 32. The moist air is able to maintain the temperature substantially uniform throughout the height of the primary combustion chamber 24. In addition, the moist air allows the combustion of solid organic materials or fuels with a low ash fusion point without the risk of sintering the ash.

In the embodiment of FIG. 1, a distribution pipe 46 is centrally located within the care of the furnace and extends along the center axis of the primary and secondary combustion chambers 24 and 26, respectively. As shown, the distribution pipe extends through the opening 22 in the intermediate wall 20 and extends downwardly through the primary combustion chamber 24 to the discharge outlet 18. A plurality of outlet openings 48 are spaced apart along the length and around the periphery of the distribution pipe 46 within the primary combustion chamber 26. A supply of fresh tertiary air is fed through the distribution pipe and discharged through the openings 48 into the primary combustion chamber 24. In the embodiment illustrated, the fresh air at ambient temperature is supplied upwardly through the pipe 46. The air is discharged radially outward from the distribution pipe 46 and supplies the air along the axial length of the primary combustion chamber 24 to cool the primary combustion chamber and maintain a substantially uniform temperature throughout the primary combustion chamber 24. In addition, the air fed through the distribution pipe provides a cooling effect to prevent overheating in the primary combustion chamber, and thus, inhibits the fusion and sintering of the ash. The amount of fresh air supplied to the furnace through the pipe 46 is sufficient to maintain the temperature of the furnace below 1100° C. and preferably at about 850° C. The additional air fed through the distribution pipe 46 also reduces the nitrogen oxide content in the flue gases discharged through the outlet 42 of the furnace. In the embodiment illustrated, the openings 48 are uniformly spaced along the length of the pipe 46 to uniformly cool the combustion chamber. In further embodiments, the openings 48 are selectively positioned to direct cooling air to hot spots in the combustion chamber.

In the process of the invention, the feed mixture of the solid material being incinerated and the primary combustion air are fed through the nozzle 32 into the furnace where the solid particles are partially incinerated in first combustion zone 38. The feed mixture contains a less than stoichiometric amount of oxygen to prevent complete combustion of the solid particles in the first combustion zone 38. The particles are then carried to the second combustion zone 40 where the particles are mixed with the secondary air supplied through the nozzle 36. The combustion of the solid particles is substantially complete in the second combustion zone 40 at a temperature which prevents the formation of sintered ash. Moist air can be supplied through the nozzles 44 and fresh air is supplied through the distribution pipe 46 having a temperature below the operating temperature of the furnace to provide a cooling effect and prevent overheating of the particles and the formation of sintered ash. The amount of cooling air supplied through the nozzles 36 and/or the distribution pipe can be varied to vary and control the temperature of the furnace. The amount of cooling air is controlled as a function of the burner capacity to optimize incineration at low temperatures.

The amount of moist air supplied through the nozzles 44 can be adjusted to control the temperature within the primary combustion chamber 24. Preferably, the temperature of the primary combustion zone is maintained at a temperature to substantially inhibit the sintering of the ash particles. The operating temperature of the primary combustion zone is determined by the caloric content of the solid material, the volume of solid material being fed to the combustion chamber and the ratio of the solid material and primary air supplied to the first combustion zone. The supply of secondary air for cooling the interior of the combustion zone can be regulated as a function of the burner capacity and to provide optimum incineration of the particles without the formation of sintered ash.

Figure 5:
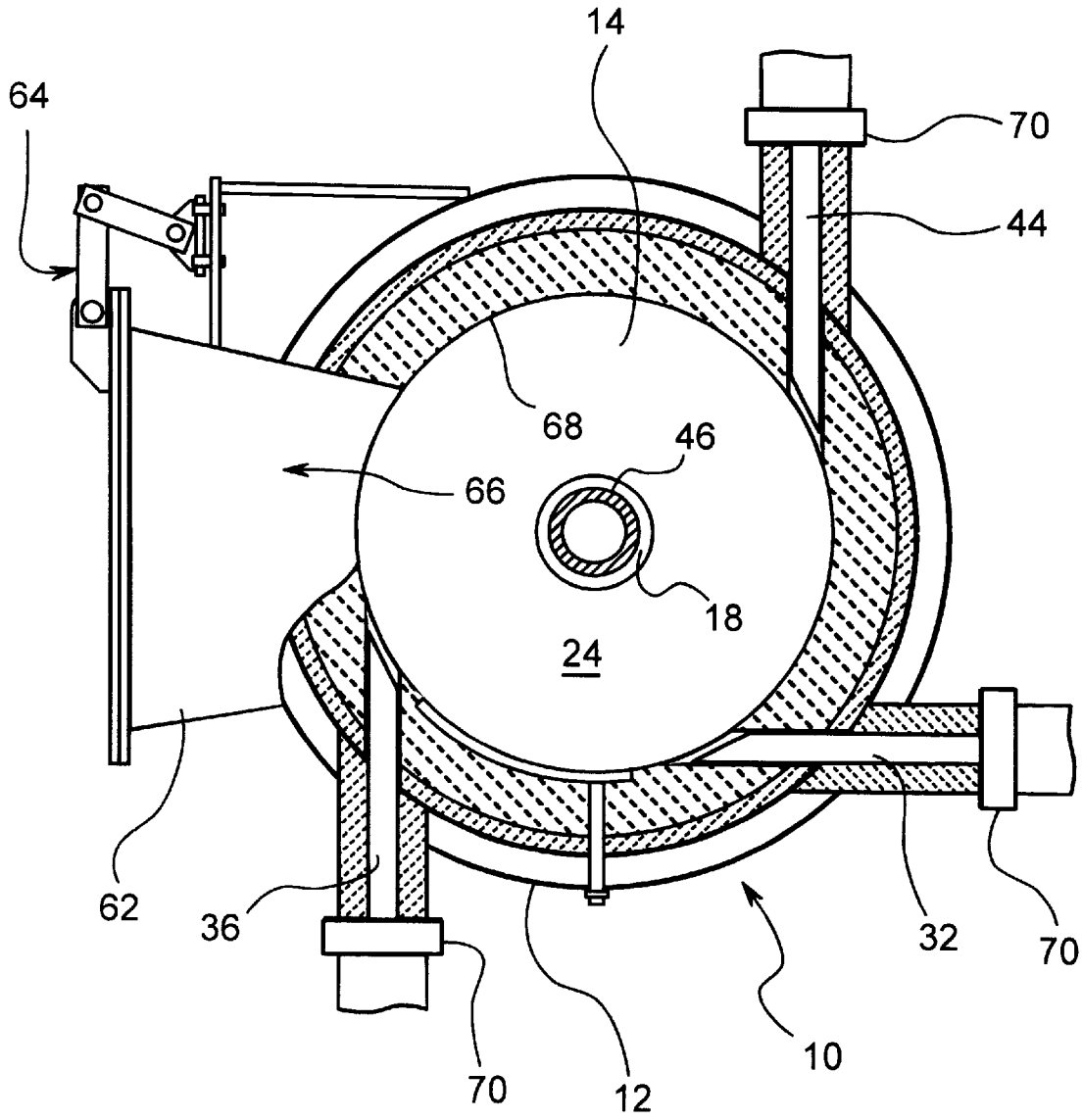
FIG. 5 is a cross-sectional top view of the cyclone furnace in a preferred embodiment of the invention showing the tangential inlets for the combustion gases.

FIG. 5 is a cross-sectional end view of the furnace showing the supply inlets into the furnace 10 of FIG. 1. As shown, the burner 28 is coupled to a housing 62 and includes a suitable control linkage 64 for controlling the amount of hot air supplied to the furnace. The housing 62 is connected to the opening 66 in the side wall 12 of the furnace 10 to direct the hot gases radially inward toward the axial center of the furnace. The side wall 12 of the furnace includes a refractory lining material 68 forming a substantially cylindrical shaped combustion chamber 24. The nozzles 32, 36 and 44 extend through the side wall 12 to supply the secondary air tangentially into the combustion chamber 24 in a manner typical in cyclone furnaces. A suitable control valve 70 is coupled to each of the nozzles to control the volume of flow through the nozzles.

Figure 2:
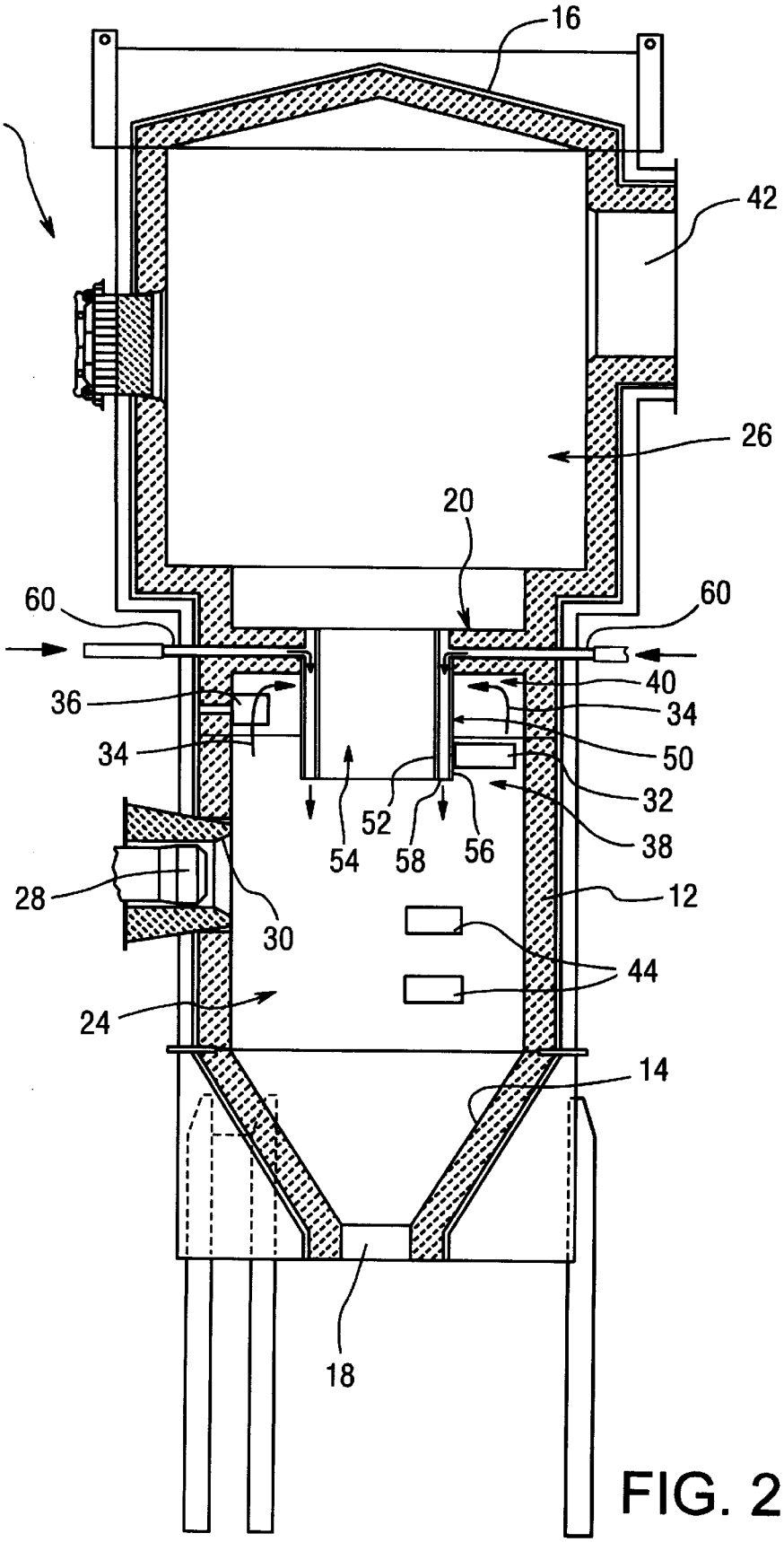
FIG. 2 is a cross-sectional side view of a cyclone furnace in a second embodiment of the invention.

Referring to FIG. 2, a further embodiment of the cyclone furnace is illustrated which is similar to the embodiment of FIG. 1, except for the addition of a submerged feed tube 50. Thus, identical components of the furnace are identified by the same reference number with the addition of a prime. As shown in FIG. 2, a submerged feed tube 50 extends axially downward into the primary combustion chamber 24 from the intermediate wall 20. The submerged tube 50 defines the center throat opening 22 in the intermediate wall 20 and is coaxial with the center axis of the furnace. Preferably, the submerged tube 50 extends axially downward through the second combustion zone 40 and into the first combustion zone 38 below or in the vicinity of the nozzle 32 for supplying the primary feed mixture of the solid material and primary combustion air.

Figure 3:
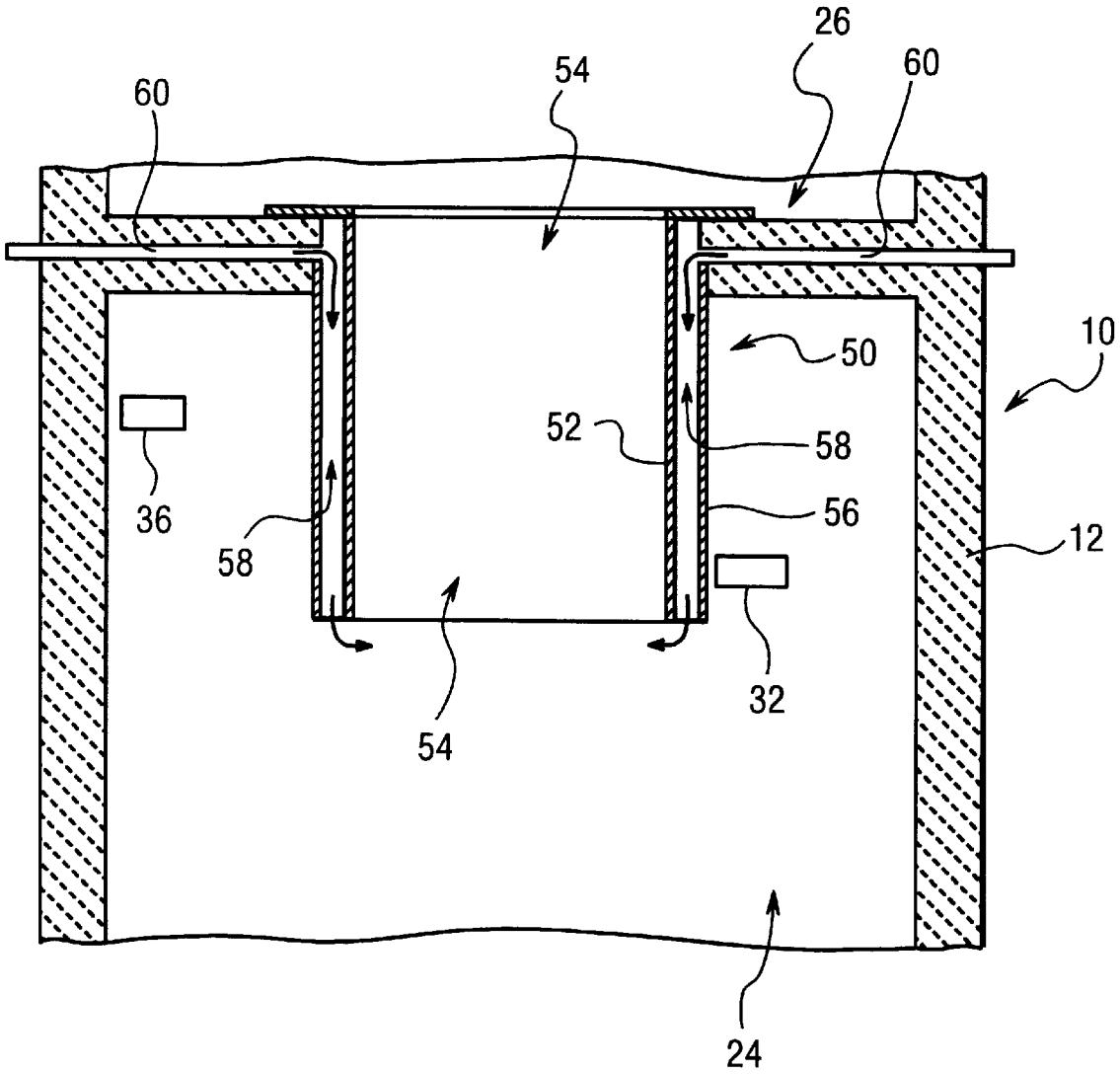
FIG. 3 is a partial cross-sectional side view of the annular feed device of the furnace of FIG. 2.

Referring to FIG. 3, the submerged tube 50 includes an inner annular wall 52 which forms an axial passage 54 at the throat between the primary combustion chamber 24 and the secondary combustion chamber 26. An to form an annular air supply passage 58. Feed pipes 60 extend through the intermediate wall 20 to the annular passage 58 to supply tertiary combustion air to the primary combustion chamber 24. The annular passage 58 directs an annular air stream downwardly into the primary combustion chamber 24.

In the process of the invention, the feed mixture of the solid material and the primary combustion air is fed through the nozzle 32 into the first combustion zone 38 where the solid particles are at least partially incinerated. A secondary air supply is fed through the nozzles 36 in the second combustion zone 40 and through the nozzles 44 as in the previous embodiment. The secondary air preferably has an oxygen content less than the oxygen content of the primary air supplied through nozzle 32. The secondary air can be recycled drying air having a high moisture content and an oxygen content of about 8% to 10% by volume.

The tertiary air is fed through the supply pipes 60 and through the annular passage 58 to direct an annular flow of fresh air at ambient temperature downwardly through the primary combustion chamber 24. The fresh air is supplied through the annular passage 58 to provide a cooling effect in the primary combustion chamber and directs the air to the lower portion of the primary combustion chamber to the core of the cyclone furnace. The secondary air mixes with the combustion gases in the primary combustion chamber where they are directed upwardly through the axial passage 54 and into the secondary combustion chamber 26. AB shown in FIG. 2, the secondary air fed through the annular passage 58 is supplied to the primary combustion chamber below the nozzle 32 where the feed mixture is introduced to the furnace. The fresh air is supplied through the annular passage 58 at a rate to maintain the temperature of the furnace below 1100° C., and preferably about 850° C.

Figure 4:
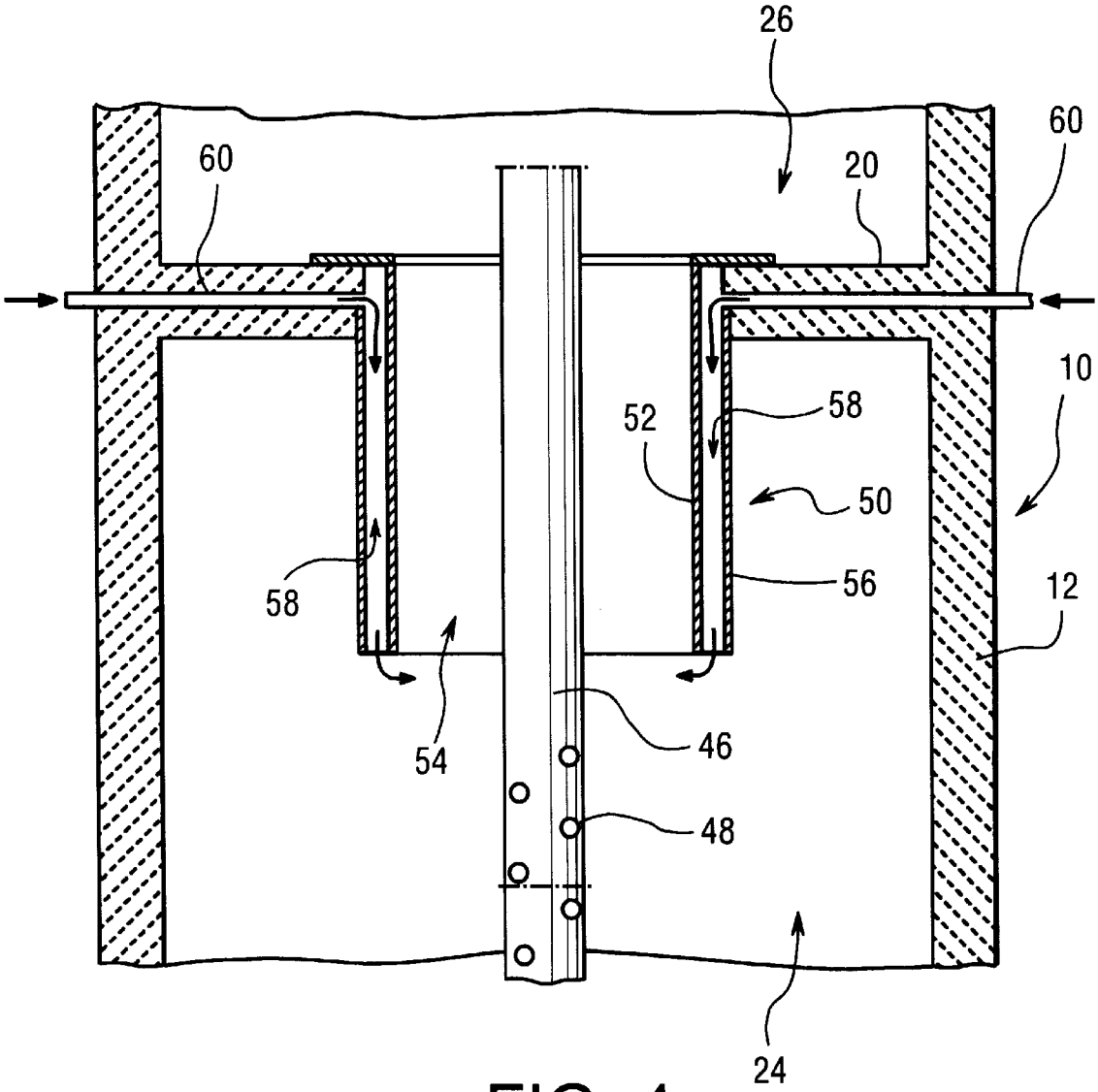
FIG. 4 is a cross-sectional side view of the cyclone furnace in a further embodiment showing the opening between a primary combustion zone and a secondary combustion zone of the furnace.

An alternative embodiment of the invention is illustrated in FIG. 4, which is similar to the furnace in the embodiments of FIGS. 1 and 2. As shown in FIG. 4, a distribution pipe 46 extends axially through the axial passage 54 of the submerged tube 50 into the primary combustion chamber 24. A supply of fresh air is fed through the distribution pipe 46 and is discharged through the openings 48 into the primary combustion chamber 24. Simultaneously, fresh air is fed through the annular passage 58 into the primary combustion chamber 24. In this manner, fresh air can be supplied to the furnace to control the temperature and extent of combustion of the solid material being incinerated. As in the previous embodiments, the fresh air is at ambient temperature and supplied at a rate to maintain the furnace temperature below 1100°, and preferably about 850°. Preferably, a furnace temperature of at least about 850° C. is maintained to prevent odors from being discharged in the exhaust gas. The fresh air mixes with the combustion gases in the furnace. The combustion gases are carried upward through the axial passage 54 into the secondary combustion chamber where they are eventually discharged through the outlet 42.

Figure 6:
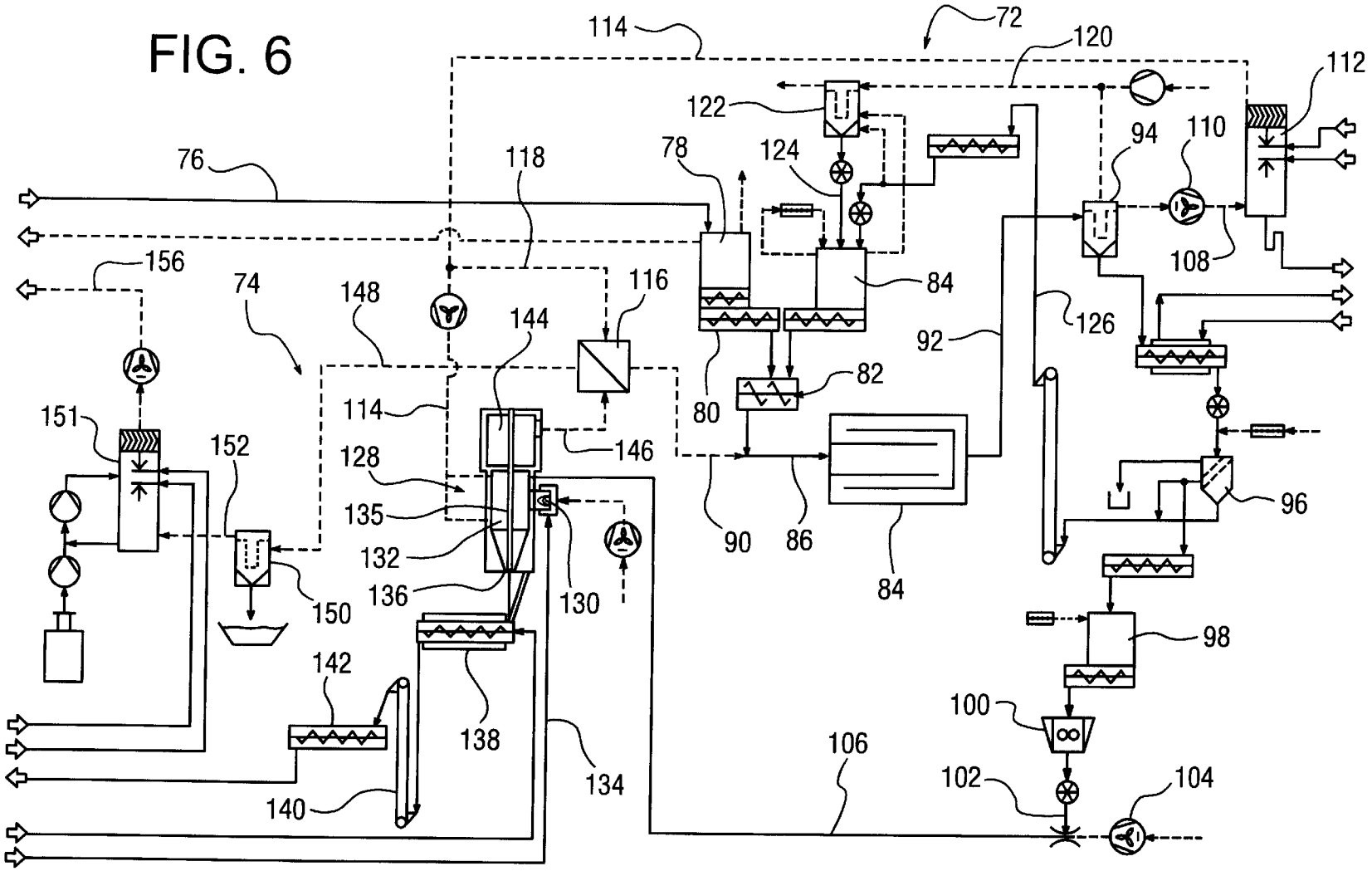
FIG. 6 is a schematic diagram of a sludge drying plant and an incinerating apparatus in accordance with the present invention.

FIG. 6 is a schematic diagram of a sludge drying plant including the incinerating apparatus of the invention. Referring to FIG. 6, the sludge drying plant includes a drying section 72 and an incinerating section 74. Previously dewatered sludge is fed through a supply pipe 76 to a storage silo 78. The previously dewatered sludge is then conveyed through a screw conveyor 80 to a mixing device 82. A portion of previously dried sludge material is supplied from a storage silo 84 by a screw conveyor and mixed with the dewatered sludge in the mixer 82 to adjust the solid-liquid ratio of the feed mixture. The resulting mixture is conveyed through a line 86 to a drier 88. In the embodiment illustrated, the drier 88 is a triple pass, hot air drier as known in the art. Hot air is supplied to the drier 88 through line 90. Alternatively, the drier can be a fluidized bed, moving fluidized bed drier or other directly or indirectly heated drier.

Moist air and the dried sludge particles are carried through line 92 to a separator 94 to remove the large particles from the exhaust gas stream. The large particles are carried through a cooling screw conveyor and discharged to a screen separator 96. The larger dried sludge particles are separated and carried to a silo 98 and then fed to a crusher 100. The crushed and ground dried sludge particles are discharged to a feed pipe 102 which is supplied with air from a blower 104 to carry the sludge particles through a feed pipe 106 to the incinerating portion of the plant.

The exhaust gas from the separator 94 is directed through a pipe 108 by blower 110 to a spray condenser 112. Water or other purifying liquid is sprayed into the condenser 112 to remove soluble contaminants and fine dust particles. The moist air from the spray condenser is carried through a pipe 114 where a portion of the hot exhaust gas is carried to a heat exchanger 116 through a pipe 118. The exhaust gas is heated in the heat exchanger 116 by the exhaust gases from the incinerator portion of the plant to reheat the air which is then supplied to the inlet of the drier 88.

A second portion of the exhaust gas from the separator 94 is carried through a pipe 120 to a second separator 122 where the smaller particulates are recovered from the exhaust gas stream and carried to the silo 84 containing the recycled dried material. A portion of the dried sludge particles separated in the separator 96 are carried through a pipe 126 to the storage silo 84.

The incinerating section 74 includes a cyclone furnace 128 substantially as shown in the previous embodiments of FIGS. 1–5. A burner 130 is provided to supply hot combustion gases to the furnace in a primary combustion chamber 132 in the lower portion of the furnace 128. The ground, previously dried sludge particles are directed into the furnace 128 through the feed pipe 106 which is positioned above the burner 130 in the primary combustion chamber 132. Fresh combustion air can be supplied through a pipe 134 to the burner 130. Moist recycled air from the spray condenser 112 is supplied through the feed pipe 114 to the primary combustion chamber 132. A source of fresh air is supplied to the distribution pipe or the annular feed pipe 135 as in the embodiments of FIGS. 1–5. The incinerated sludge particles are removed from the furnace through an outlet 136 where they are conveyed through a cooling conveyor 138. The cooled incinerated sludge particles are conveyed through conveyors 140 and 142 to a suitable discharge site.

The combustion gases in the cyclone furnace 128 are carried from the primary combustion chamber 132 through the secondary combustion chamber 144 and discharged through an outlet pipe 146. The hot exhaust gases are carried through the pipe 146 to the heat exchanger 116 for heating the feed air to the drum drier of the drying section. The exhaust gases exit the heat exchanger 116 through a pipe 148 to a separator 150 for separating particles in the exhaust gas stream. The exhaust gas stream is then carried through a pipe 152 to a spray condenser 154 for treating the exhaust gas before discharging through a discharge pipe 156.

In the process of FIG. 6, previously dried sludge particles are supplied to a cyclone furnace above the burner to incinerate the sludge particles and remove the organic components of the sludge particles prior to discharge. Moist air from the spray condenser in the drying section is fed to the furnace to control the temperature in the furnace and prevent overheating of the sludge particles thereby preventing the formation of sintered ash.

While several embodiments have been shown to illustrate the invention, it will be understood by those skilled in the art that various changes and modifications can be made therein without departing from the scope of the invention as defined in the appended claims.

What is claimed is:

1. An apparatus for incinerating a solid particulate material comprising:

a cyclone furnace having a furnace wall defining a primary combustion chamber and having a lower end and an upper end;

a burner coupled to said furnace wall for introducing hot combustion gases into said primary combustion chamber;

a first feed inlet for feeding a feed mixture tangentially into a primary combustion zone in said primary combustion chamber, said feed mixture including a solid particulate material and a first source of combustion air in less than a stoichiometric amount needed for complete combustion of said solid particulate material; and a second feed inlet for feeding a second source of air into a secondary combustion zone in said primary combustion chamber at a location above said feed of said first source of combustion air.

2. The apparatus of claim 1, further comprising a feed pipe extending axially through said primary combustion chamber for supplying a tertiary source of air into said primary combustion chamber in an amount to maintain said primary combustion chamber at a temperature of about 850° C.

3. The apparatus of claim 2, wherein said feed pipe extends through a center of said primary combustion chamber, said feed pipe including a plurality of air outlet openings spaced along a length of said primary combustion chamber for feeding said tertiary source of air radially outward into said primary combustion chamber.

4. An apparatus for incinerating a solid particulate material comprising:

a furnace wall defining a primary combustion chamber and having a lower end and an upper end;

a burner coupled to said furnace wall for introducing hot combustion gases into said primary combustion chamber;

a first feed inlet for feeding a feed mixture into a primary combustion zone in said primary combustion chamber, said feed mixture including a solid particulate material and a first source of combustion air in less than a stoichiometric amount needed for complete combustion of said solid particulate material;

a second feed inlet for feeding a second source of air into a secondary combustion zone in said primary combustion chamber at a location above said feed of said first source of combustion air; and an annular air inlet positioned in said primary combustion chamber for directing an annular column of fresh air downwardly into said primary combustion chamber.

5. The apparatus of claim 4, said primary combustion chamber having a central opening in said upper end communicating with a secondary combustion chamber, and said annular air inlet surrounding said central opening.

6. The apparatus of claim 5, wherein said annular inlet comprises an inner annular wall and an outer annular wall, said inner and outer annular walls having a length to extend toward said lower end beyond said first feed inlet.

7. A furnace for incinerating a solid particulate material comprising:

at least one side wall, a bottom wall, a top wall, and an intermediate wall extending substantially perpendicular to said side wall in an inward direction toward an axial center of said furnace, said intermediate wall having a throat opening concentric with a center axis of said furnace and defining a primary combustion chamber in a lower portion of said furnace and a secondary combustion chamber in an upper portion of said furnace;

a feed inlet device in said side wall for feeding a feed mixture tangentially into said primary combustion chamber, said feed mixture including a solid particulate material and combustion air in less than a stoichiometric amount needed for complete combustion of said particulate material; and at least one feed pipe for feeding a supply of fresh air into said center of said primary combustion chamber in an amount to cool said primary combustion chamber at a temperature of about 850° C., said feed pipe comprising an annular pipe having an annular outlet surrounding said opening in said intermediate wall for feeding fresh combustion air into said primary combustion chamber in a substantially downward direction toward said bottom wall.

8. The furnace of claim 7, wherein said annular pipe has a length extending axially into said primary combustion chamber beyond said feed inlet device and for directing said combustion air in a downward direction.

9. The furnace of claim 7, wherein said annular pipe comprises an inner wall forming an axial passage between said primary combustion chamber and said secondary combustion chamber.

10. The furnace of claim 9, wherein said annular pipe further comprises an outer wall forming said annular outlet between said inner and outer walls for directing a substantially annular stream of air into said primary combustion chamber.

11. The furnace of claim 7, further comprising a cylindrical pipe concentric with said annular pipe and extending through said first feed pipe for feeding air into said primary combustion chamber.

12. The furnace of claim 11, wherein said cylindrical pipe includes a cylindrical side wall having a plurality of outlet openings for feeding said air in an outward direction with respect to said cylindrical side wall into said primary combustion chamber.

13. The apparatus of claim 3, wherein said feed pipe extends completely through said primary combustion chamber and wherein said air outlet openings are spaced along the length of said feed pipe to feed said tertiary source of air substantially along a length of said primary combustion chamber.

14. The apparatus of claim 1, wherein said first feed inlet is positioned above said burner.

15. The apparatus of claim 3, further comprising a cooling air inlet positioned below said burner for supplying cooling air to said primary combustion chamber.

16. The furnace of claim 7, further comprising a burner for directing combustion gases into said primary combustion chamber.

17. The furnace of claim 16, wherein said side wall includes an opening and said burner is positioned in said opening for directing said combustion gases into said primary combustion chamber.

18. The furnace of claim 16, wherein said feed device is positioned above said burner.

19. The furnace of claim 18, further comprising a second feed inlet for supplying a secondary source of air into said primary combustion chamber, wherein said second feed inlet is positioned above said first feed inlet.

20. A furnace for incinerating a solid particulate material comprising:

at least one side wall, a bottom wall, a top wall, and an intermediate wall extending substantially perpendicular to said side wall in an inward direction toward an axial center of said furnace, said intermediate wall having a throat opening concentric with a center axis of said furnace and defining a primary combustion chamber in a lower portion of said furnace and a secondary combustion chamber in an upper portion of said furnace;

a feed inlet device in said side wall for feeding a feed mixture tangentially into said primary combustion chamber, said feed mixture including a solid particulate material and combustion air in less than a stoichiometric amount needed for complete combustion of said particulate material; and at least one feed pipe for feeding a supply of fresh air into said center of said primary combustion chamber in an amount to cool said primary combustion chamber at a temperature of about 850° C., said feed pipe extending completely through said primary combustion chamber and feeding said fresh air substantially along an entire length of said primary combustion chamber.

21. The furnace of claim 20, wherein said feed pipe extends axially through said primary combustion chamber and includes a plurality of openings positioned along the entire length of said primary combustion chamber.

* * * * *